US006502605B2

(12) United States Patent
Goessl et al.

(10) Patent No.: US 6,502,605 B2
(45) Date of Patent: Jan. 7, 2003

(54) PROCESS FOR THE PRODUCTION OF A FACE-TO-FACE CARPET FABRIC

(75) Inventors: Rainer Goessl, Leukersdorf (DE); Thomas Seidel, Hartmannsdorf (DE)

(73) Assignee: Schoenherr Textilmaschinenbau GmbH, Chemnitz (DE)

( * ) Notice: Subject to any disclaimer, the term of this patent is extended or adjusted under 35 U.S.C. 154(b) by 0 days.

(21) Appl. No.: 09/903,067

(22) Filed: Jul. 11, 2001

(65) Prior Publication Data

US 2002/0036021 A1 Mar. 28, 2002

(30) Foreign Application Priority Data

Aug. 16, 2000 (EP) ..... 00117599

(51) Int. Cl.[7] ..... D03D 27/10
(52) U.S. Cl. ..... 139/21; 139/398
(58) Field of Search ..... 139/21, 398, 11, 139/20, 27, 37, 46, 116.5, 291 C

(56) References Cited

U.S. PATENT DOCUMENTS

| | | | | |
|---|---|---|---|---|
| 3,327,738 A | * | 6/1967 | Sabbe | 139/21 |
| 3,612,110 A | * | 10/1971 | Wildi et al. | 139/383 R |
| 5,398,730 A | * | 3/1995 | Derudder et al. | 139/21 |
| 5,655,573 A | * | 8/1997 | Gheysen et al. | 139/21 |
| 6,092,562 A | * | 7/2000 | Debaes | 139/21 |
| 6,095,198 A | * | 8/2000 | Debaes | 139/21 |

FOREIGN PATENT DOCUMENTS

| | | |
|---|---|---|
| BE | 675494 | 5/1966 |
| DE | 574920 | 3/1933 |
| EP | 0628649 | 12/1994 |
| EP | 0922799 | 6/1999 |

OTHER PUBLICATIONS vergl. Hans Osswald, "Die Teppichindustrie" 1965, Melli- and Textilberichte, Heidelberg, Seiten 112, Abb. 176 und 177—No Trans.

* cited by examiner

*Primary Examiner*—Amy B. Vanatta
*Assistant Examiner*—Robert Muromoto
(74) *Attorney, Agent, or Firm*—Jordan and Hamburg LLP

(57) ABSTRACT

A process for the production of a face-to-face carpet fabric on a double pile loom having at least two filling insertion planes, uses filling yarns, stuffer warp yarns, and chain warp yarns to form two back cloths. The filling yarns are inserted into each back cloth as back fillings and inner fillings. Groups of chain warp yarns, individual yarns of which between their respective last binding to an inner filling and the succeeding last binding to a back filling form a holding length, are assigned to each back cloth. All patterning pile loops are stretched over back fillings. and the pattern repeat of a group of chain warp yarns is selected to be greater than six. The holding lengths of a chain warp yarn extend over at least three filling insertion cycles.

12 Claims, 7 Drawing Sheets

PROCESS FOR THE PRODUCTION OF A FACE-TO-FACE CARPET FABRIC

BACKGROUND OF THE INVENTION

The invention relates to a process for the production of a face-to-face carpet fabric on a double pile loom having at least two filling insertion planes, using filling yarns, stuffer warp yarns, and chain warp yarns to form the back cloths in the form of a bottom cloth and a top cloth, as well as frames of pile yarns per warp course to form the patterned pile layer between the two back cloths, whose respectively non-patterning pile yarns are tied into the back cloths of the top and/or bottom cloths largely under tension and whose respectively patterning pile yarns are stretched alternately between the filling yarns of the top cloth and the bottom cloth; whereby the filling yarns within a pattern repeat in both back cloths are inserted in at least two different filling insertion planes, at least once as a back filling outside the stuffer warp and at least once as an inner filling inside the stuffer warp; whereby in each back cloth, groups of chain warp yarns are fed according to a prescribed pattern repeat, forming weaving sheds, whereby the chain warp yarns of a group staggered within a pattern repeat in the warp direction, loop in harmonizing weaving sequences outside the back fillings and inner fillings with respect to a back cloth, whereby each chain warp yarn of a group—within a weaving sequence—between its respective last binding to an inner filling and the subsequent last binding to a back filling is guided over several filling insertion cycles behind the inner fillings, forming a holding length, and then inside an inner filling in a compensating length, forming a weaving shed, and whereby the pattern repeats of the chain warp yarns are designed so that the tie-in length of the chain warp yarns of a group within each pattern repeat is compensated for between them.

A process of this type is known from EP 628 649 A1. It shows, for example, the customary state of the art up to now. The chain warps are arranged regularly in groups of two chain warp yarns. Each group is assigned respectively to a warp course. Each warp course has respectively such a group of chain warp yarns, at least one stuffer warp yarn, and a frame of pile yarns.

A group of chain warp yarns is characterized in that it holds within its pattern repeat all the back fillings and all the inner fillings in its effective area on the stuffer warp, which is tied in under tension, and optionally on the dead piles, which are tied in under tension.

It is customary thereby to guide the individual chain warp yarns of a group within a pattern repeat of a specific weaving sequence by means of shafts during the formation of the weaving shed. Because only a single warp beam is available as a rule for the chain warp yarns on a double pile loom, the chain warp yarns have been woven in regularly according to a uniform weaving sequence, so that the tie-in length and thus the tension of all chain warp yarns of a group can be held constant within a pattern repeat.

Those skilled in the art regularly focus on not exceeding a certain pattern repeat size and a certain temporary difference in consumption in order to ensure that the tension of the chain warp yarns running from a single warp beam is uniform. In practice, a so-called two-course rib weave (cf. Hans Osswald, "Die Teppichindustrie" 1965, Melliand Textilberichte, Heidelberg, p. 112, FIGS. 176 and 177) was used regularly on face-to-face carpet looms for the two-shuttle production of the backing. In this two-shuttle three-shot weave with a pattern repeat of six filling insertion cycles, in one of the two back cloths a chain warp yarn regularly extended diagonally from one inner filling to a back filling inserted four courses later and from there back again to an inner filling in the two immediately succeeding courses.

With this type of tie-in, the intermediate pile binding point was drawn very tightly to the previously formed back cloth by means of the diagonal section, let us call it the "holding length", of the chain warp yarn. The shorter section guided through the back cloth, which we call the "compensating length," then fixed the position of the chain warp yarn in the back cloth, so that when the chain warp yarn tension slackened in the shed area, the finished fabric could not loosen again.

Such a weave already ensures that the quality of the tie-in of the pile legs will be serviceable. There are specific limits to the filling density, however.

The asymmetrically tied-in chain warp causes the fillings carrying and supporting the pile loops to be deflected in the warp direction along the stuffer warp or along the dead piles. The exit direction of the pile loops regularly deviates by up to 10° and more from the vertical to the back cloth. Such an inclined position of the pile legs is regularly the reason that certain required resilience properties can only be ensured by increasing the pile density and/or by raising the pile height. Both measures for ensuring the desired resilience properties require a considerable additional expense for pile material. The costs for a carpet produced in this manner are correspondingly high.

A further disadvantage of this asymmetrical weave of the back cloth is that the recovery power of the pile cover under partial severe loading—for example by the feet of pieces of furniture—is insufficient.

Intensive brushing processes and the like may be required to remove partial pressure points. Usually, however, such pressure points leave permanent and clearly visible deformations in the pile surface.

Due to the inclined position of the pile legs, carpets woven in this manner cannot be lined up next to one another for contract use. The differing reflection angles of the incident light, which are caused as a function of the respective weave direction, give an observer the impression that there are color defects.

In order to limit the inclination of the pile angles, attempts have already been made (cf. Osswald, p. 112) to increase the thickness of the back cloth by inserting intermediate fillings that separate the stuffer warp from the dead pile strand. It was also hoped that this would enable the deflection of the fillings on the back cloth to be reduced.

This measure, with a specific arrangement of the fillings inserted successively or simultaneously in the area of a pattern repeat, had only limited success as far as the orientation of the pile legs was concerned (cf. DE 574 920).

There was a distinct increase in the quantity of material used. The pile density was not increased further by these measures.

In EP 628 649 A1 referred to initially, a solution to this problem was attempted in that other filling yarn arrangements were used, while keeping the intermediate filling. The chain warp yarns were guided over the filling yarns in such a way that they loaded the filling yarns approximately symmetrically in the warp direction. The filling yarns—inserted as back filling, intermediate filling, or inner filling—are this held largely immobile in the warp direction.

The size of the pattern repeat was maintained in the customary manner with four filling insertion cycles. This led to an increased yarn material requirement for chain warp yarns. The pile density, measured in the warp direction, also remained clearly limited in this case. Carpets produced in this manner frequently had to be placed in lower quality categories due to inadequate density.

For the said reasons, the production of very dense pile goods was normally previously reserved for the single-shuttle weaving technique, in which not every pile loop is tied to a back filling. Much lower productivity was accepted.

EP 922 799 A2 shows an attempt to increase pile density even using a two-shuttle method. In each back cloth. the top cloth and the bottom cloth, the pile loops in a warp course are stretched alternately on a back filling and then on an intermediate filling—which is inserted between the stuffer warp and the dead piles. The pattern repeat of the chain warp yarns extends over eight courses. The initially defined holding length is formed in each weaving direction in three successive courses.

The goods achievable using intermediate fillings and back fillings as pile carrying fillings are of lower quality. The appearance of the back of the carpet differs considerably from the appearance of the pile side. The pile loops at the borders of the pattern, which are only bound via an intermediate filling, have a distinctly lower pull-out resistance. During the usual care with a vacuum cleaner, these pile loops are gradually detached from their weave and removed. The final result of this is unclear pattern contours. A higher pile density is only achieved to a limited extent.

In Belgian Patent 675 494, an attempt was made to achieve a greater pile density even when all the pile loops are stretched over a back filling, using a similar basic weave of the chain warp. Here, the dead piles were guided under tension on the back of the bottom cloth and after the weaving procedure and the separation of the face-to-face carpet fabric, were scratched off from the back of the bottom cloth in the pile plane. These so-called "scratch-off goods" are known to be of unsatisfactory quality.

It is an object of the present invention to provide a process for fixing the back cloths with dead piles distributed in the top cloth and bottom cloth and tied in by means of chain warp yarns, which process on the one hand ensures a largely vertical tie-in of the pile legs in the back cloths, enables a carpet fabric to be produced with a high pile density, and ensures that the quantity of material used in the area of the back cloths can be distinctly reduced.

It is furthermore an object of the invention to ensure, by means of the measures found, that the resilience properties of the carpet are the same or better, the quantity of pile material used being reduced.

SUMMARY OF THE INVENTION

This objective is accomplished by a process in accordance with which the combination of the designated process steps prevents back fillings from being deflected in the warp direction relative to the inner fillings. It prevents the points of intersection of two chain warp yarns of two groups always being positioned in one and the same transversal area of the back cloth in adjacent warp courses during the shed treadle motion.

Surprisingly, the combination enables the pile density in the warp direction to be increased by up to 30%, depending on the weave variant selected and the thickness of the filling yarns used.

The pile loops project regularly from the back cloth largely vertically and are stable and securely supported in this position. This leads to excellent resilience properties in the finished carpets.

The recovery power of the pile surface after partial severe loading is optimized.

The varying reflectance of the colors as a function of weave direction is distinctly reduced. The use of pile carpet for contract carpeting is no longer generally excluded.

Depending on the weave selected in the scope of the invention, chain warp material can be saved in orders of magnitude of between 10 and 25%.

A saving of pile material results from the fact that a lower pile height can be selected to achieve the same resilience properties, due to the vertical pile tie-in.

In addition to said advantages, another embodiment has the additional advantage that the pile binding points on the carpet back are distributed uniformly and free of lines, especially when 4 chain warp yarns are used per group. The carpet back resembles the classical hand-knotted carpet and has the additional advantages of the taut stuffer warp.

In contrast to known basic weaves, the pile density was able to be increased with a relatively small pattern repeat by up to 15 pile rows/dm, and in variants with a substantially larger pattern repeat by up to more than 100 pile rows/dm.

Depending on the length of the pattern repeat, the modification according to a further embodiment enables a distinct saving (up to over 25%) of chain warp material while maintaining the classical back appearance of a carpet—analogous to the conventional 2/2 rib weave. Here too it is possible to increase the pile density considerably.

In accordance with an advantageous embodiment of the invention, a group of the chain warp yarns is suitably distributed over 3 to 4 warp courses. Again there is a high pile density and a distinct saving of chain warp material.

The advantages of the weave according to a further embodiment are that in addition to an attractive saving of chain warp material, improved pile position, and improved pile density, high wear resistance can be ensured, even in the unbound state.

In accordance with another embodiment, a variant is defined that is important in particular for working with three overlapping filling insertion planes. The most essential advantages are a high saving of chain warp material while maintaining high wear resistance of the carpet.

Yet a further advantageous embodiment describes a second basic method to achieve the object of the invention in a limited area of the pattern repeat, which has the same results as those described in relation to the initial embodiment described above.

A still further embodiment of the invention is directed to an almost equivalent method to the first embodiment described herein. The pile loops do not tie over a back filling in every case. The pattern of the front face of the carpet is not reproduced completely on the back, however. This weave is desirable where the demands on the quality of the carpet are not particularly high and the price is to be kept correspondingly low.

The invention is explained in greater detail below by means of examples with reference to the accompanying drawings.

DETAILED DESCRIPTION OF THE INVENTION

Figure 1:
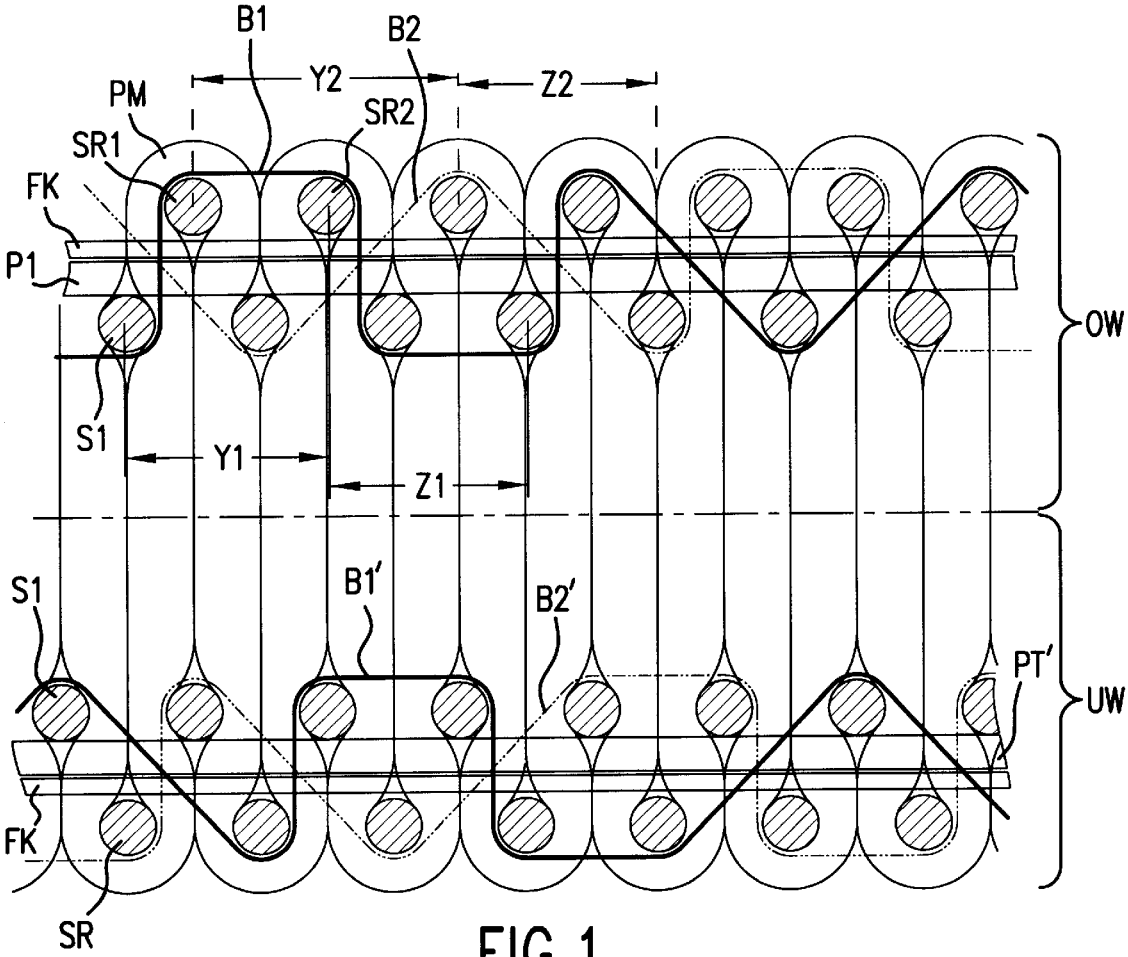
FIG. 1 is a sectional view through a face-to-face carpet fabric along the warp direction.

The face-to-face carpet fabric shown in FIG. 1 consists of a top and a bottom back. cloth, top cloth OW and bottom cloth UW, and of patterning pile yarns PM alternating regularly between the top and bottom back cloth, which pile yarns are separated in the riddle between top cloth OW and bottom cloth UW after the weaving procedure.

Each of back cloths OW, UW contains stuffer warp yarns FK running in the warp direction and non-patterning pile yarns oriented parallel to them that are designated below as dead piles PT or dead pile strand. These two yarn groups FK, PT are held on the outside by back fillings SR and on the inside by inner fillings SI. The position of the back fillings SR. and inner fillings SI is fixed by chain warp yarns B (B1, B2 in FIG. 1). Chain warp yarns B are arranged in groups. The size of the group varies normally between two (e.g. B1, B2) and four (e.g. B13 to B16) chain warp yarns B. The number of chain warp yarns B in a group is governed by the minimum number of yarns needed to bind all the back fillings SR and inner fillings SI to the back cloth once each within a pattern repeat R. (Adjacent groups can also augment one another with respect to one or more binding points.)

In one pattern repeat of chain warp yarns B we find as a rule at least one holding length Y and at least one compensating length Z.

The first holding length Y1 of chain warp yarn B1 of the B1, B2 group shown in FIG. 1 begins after inner filling SI shown above left. It encloses upper left back filling SR1 and then second back filling SR2. In the subsequent first compensating length Z1, this chain warp yarn B1 is guided to subsequent inner filling SI and from there in the same plane to the next inner filling SI. If all chain warp yarns B1, B2 of the group were to bind with the same tie-in length, the pattern repeat of a group. would already be ended here.

In the present case, however, second chain warp yarn B2 binds differently. It alternates respectively from a filling yarn lying opposite the first-named filling yarn pair to the net filling yarn, which is inserted three filling insertions later. This chain warp yarn B2 brings the necessary longitudinal tension to the backing by means of another holding length Y2 and ensures that back fillings SR that carry pile loops and inner fillings SI that guide pile loops, are drawn against one another so tightly that the pile loops are prevented from lying at an angle.

In order to ensure that the tie-in length of both chain warp yarns B1, B2 remains the same within a pattern repeat, both chain warp yarns B1, B2 reciprocally change their weave twice within a pattern repeat R—optionally in a special change length W. As a result, each chain warp yarn B1, B2 has two different holding lengths Y1, Y2 and also two different compensating lengths Z1, Z2.

In both weaves, holding length Y1, Y2 and also respective compensating length Z1, Z2 extend over three filling insertion cycles. Because of change lengths W, the total pattern repeat amounts to e.g. 20 or 28 filling insertion cycles. After three or five fillings respectively, two chain warp yarns B1, B2 change regularly from the back plane inwards or vice versa.

The size of pattern repeat R and individual binding lengths X1, X2 (FIG. 2) should be selected thereby such that a temporary slackening of individual chain warp yarns B1, B2 of a group while being doffed from the warp beam can also be avoided with certainty. The tension of chain warp yarns B should be monitored before entry into the shed-forming zone and must-not fall below a value of 2 to 4 N.

Figure 1A:
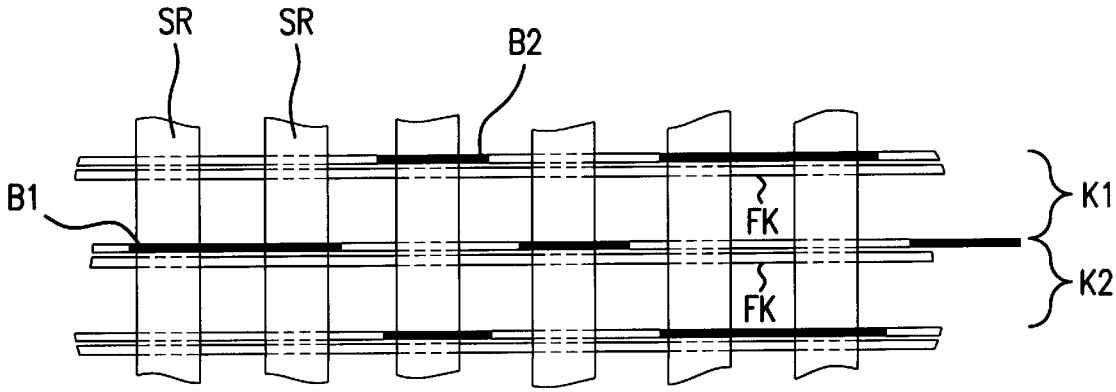
FIG. 1*a* is a top view of the face-to-face carpet fabric according to FIG. 1.
Figure 5:
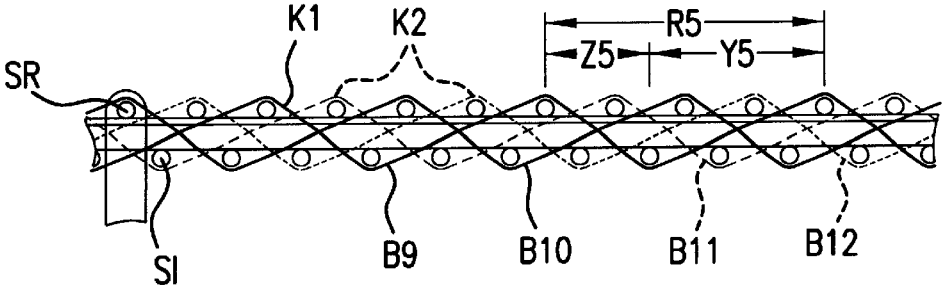
FIG. 5 is a representation as in FIG. 2 with regularly symmetrically binding chain warp yarns arranged in pairs in two adjacent warp courses.
Figure 6:
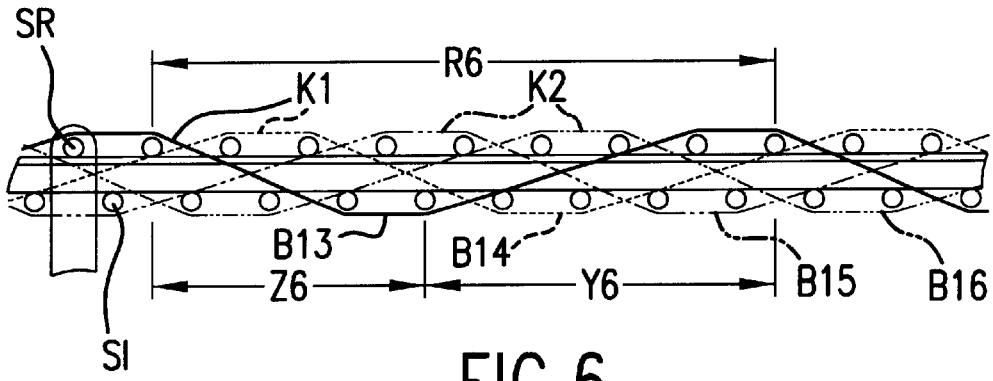
FIG. 6 is a representation as in FIG. 5 with back and inner fillings bound in pairs.

In the present case, chain warp yarns B1, B2 of the group can be distributed over two adjacent warp courses K1, K2 (FIG. 1*a*, FIG. 5 and FIG. 6). In spite of this distribution, they hold the relatively voluminous back fillings SR against stuffer warp FK and inner fillings SI securely enough against dead pile strands PT in the respective back cloth OW or UW.

In FIGS. 2 to 8 below, weave designs are shown based on top cloths OW in which the back cloth only has back fillings SR and inner fillings SI.

FIGS. 9 to 15, in contrast, show back cloths, for example of top cloths OW, that also have intermediate fillings SZ (SZ1, SZ2, SZ3) between the taut stuffer warp FK and the voluminous dead piles PT.

Figure 2:
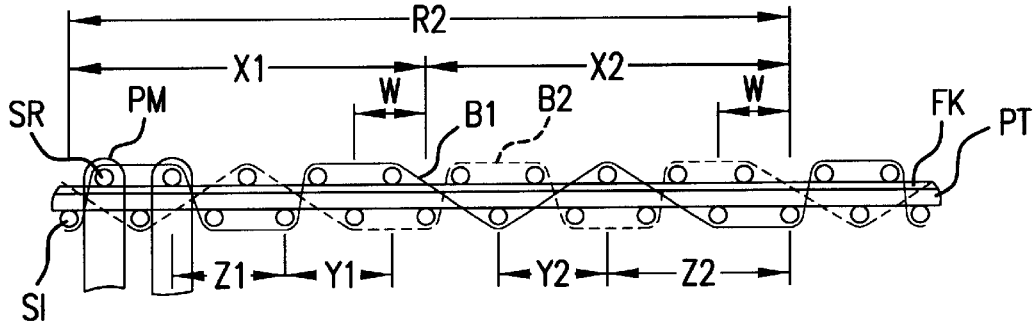
FIG. 2 is a schematic weave design of one of the back cloths, a top cloth, with an irregular weave pattern of the chain warp yarns.

FIG. 2 shows a weave as was also described in relation to FIG. 1. Only change lengths W are positioned and formed somewhat differently here. Special change lengths W are provided in FIG. 2 in addition to holding lengths Y1, Y2 and compensating lengths Z1, Z2. Change lengths W can also be assigned to compensating lengths Z1, Z2.

Figure 3:
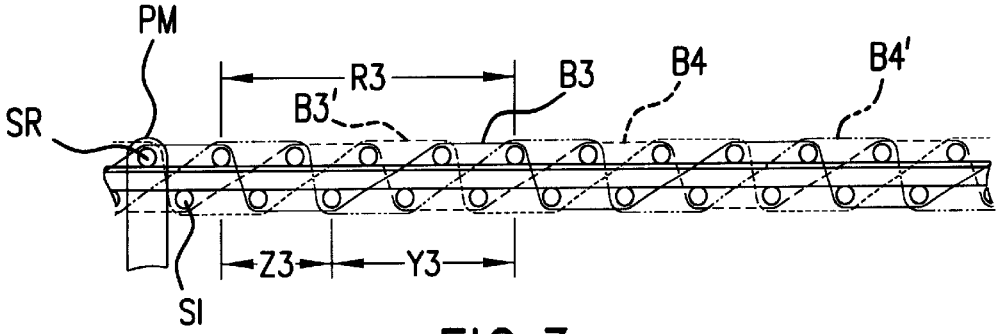
FIG. 3 is a representation as in FIG. 2 with a regular pattern repeat.

The weave variant of FIG. 3 shows a regular paired interlacing of back fillings SR and inner fillings SI. It achieves the object of the invention by very simple means. After the first tied-in back filling SR, chain warp yarns B3, B4 in the first warp course maintain their position in the weaving shed until the second back filling of this pair is beaten up. Holding length Y3 brought from the last inner filling SI before the paired binding of the back fillings is gripped in the already finished fabric such that no elastic component can become active in this yarn length and deflect the last inserted back filling SR laterally. The pile legs are not deflected and stand almost vertical in the back cloth. In the adjacent warp course, a further pair of chain warp yarns B3' and B4' of this group binds staggered with respect to the first pair by two courses.

Figure 4:
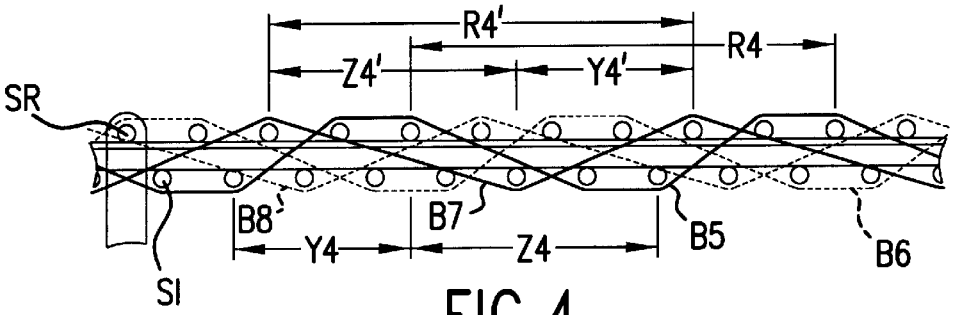
FIG. 4 is a schematic weave design with chain warp yarns binding irregularly in long lengths in two adjacent warp courses.

The weave design of FIG. 4 shows larger lengths with different weave designs of chain warp yarns B5, B6, B7, B8. Two chain warp yarns B5, B6 bind regularly in pairs over back fillings SR or inner fillings SI thereby.

Their holding lengths Y4 and compensating lengths Z4 each extend over five filling insertion cycles. The two chain warp yarns B7, B8 each bind only over one filling, a back filling SR or an inner filling SI.

Holding length Y4' extends over five filling insertions, while compensating length Z4' includes seven filling insertions. It is advisable to alternate these weave designs reciprocally after certain lengths—as already mentioned in relation to FIG. 2. If it is desired to avoid such changes W, the two differently binding pairs of chain warp yarns B5, B6 or B7, B8 respectively must be doffed from two different warp beams.

FIG. 5 shows a weave design in which individual chain warp yarns B9, B10, B11, B12 are interlaced almost symmetrically and regularly according to a single weave design. A deflection of the pile legs in any direction is reliably avoided and individual chain warp yarns B9, B10, B11, B12 of a group are preferably arranged in pairs in adjacent warp courses K1, K2. It is also possible to arrange these chain warp yarns B9, B10, B11, B12 individually respectively in four adjacent warp courses.

Holding lengths Y5 include five filling insertions, while compensating lengths Z5 finish after three courses each.

The embodiment of FIG. 6 is essentially comparable to FIG. 5. The difference is that chain warp yarns B13, B14, B15, B16 bind over pairs of filling yarns instead of over individual fillings. In this embodiment a very high fabric density is achieved with an absolutely vertical orientation of the pile legs. At a pattern repeat size of 16, there are nine courses in holding length Y6 and seven courses in compensating length Z6. When suitable filling yarns are used, it is possible to reduce the need for chain warp yarns distinctly, if the individual chain warp yarns B of a group are distributed over several warp courses.

Figure 7:
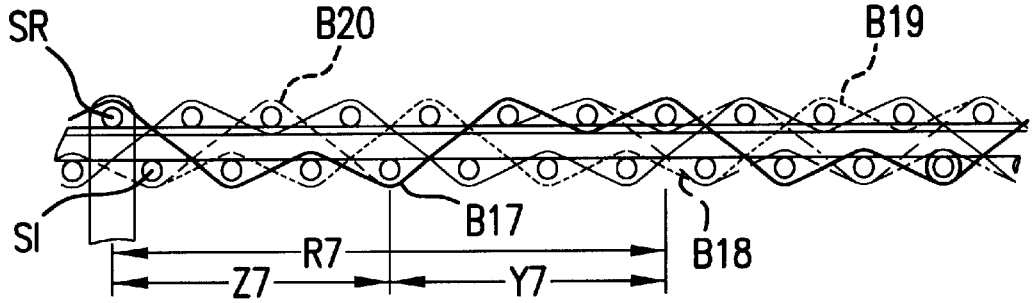
FIG. 7 is the representation of a weave pattern with alternating tabby weave over each three back- or inner fillings.

The weave of FIG. 7 differs from FIG. 6 in that the number of by a chain warp yarn B17, B18, B19, B20 in the area of back fillings SR and inner fillings SI is further increased. In combination with other chain warp yarns B17, B18, B19, B20 of a group, back fillings SR or inner fillings SI are respectively fixed separately in tabby weave. Holding length Y7 and also compensating length Z7 extend respectively over seven filling insertion cycles.

Figure 8:
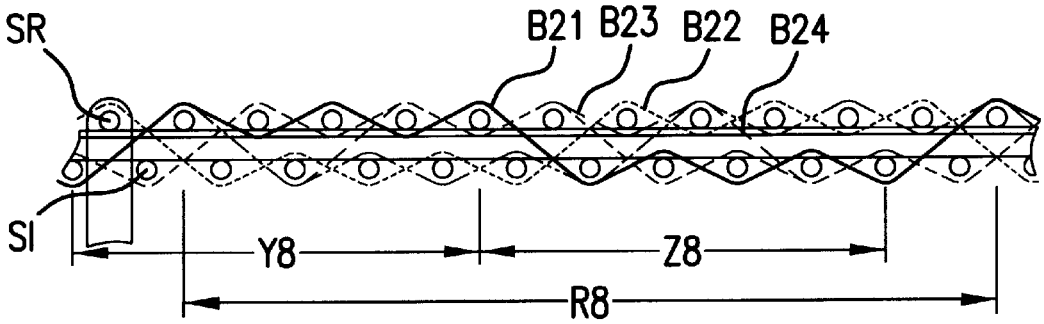
FIG. 8 is a representation as in FIG. 7 with an extended tabby weave in the area of the back- and inner fillings.

In FIG. 8 the number of filling yarns bound in this manner is increased to five fillings per filling yarn plane. Chain warp yarns B21, B22, B23, B24 of a group are staggered so that on the one hand all back fillings SR and inner fillings SI are woven reliably and that back fillings SR are bound to inner fillings SI at regular intervals.

Figure 9:
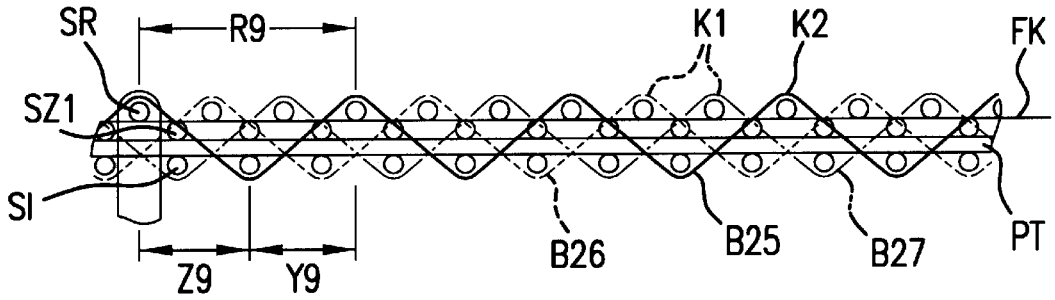
FIG. 9 is a representation of a top cloth with an additional intermediate filling and regular guiding of the chain warps and a distribution of the chain warps on two warp courses.
Figure 10:
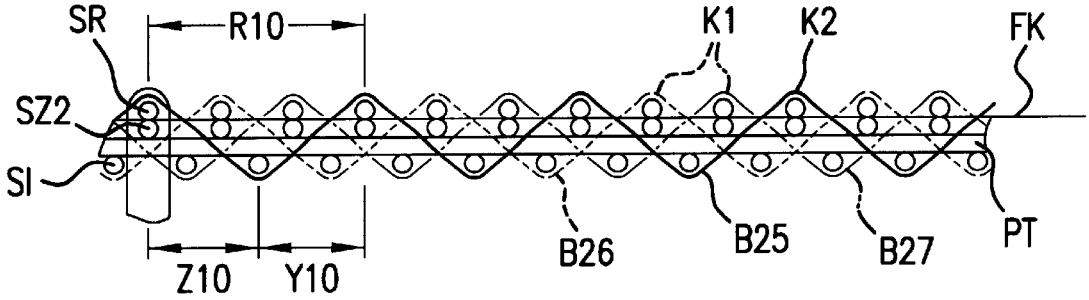
FIG. 10 is a representation according to FIG. 9 with a modified arrangement of the intermediate fillings.
Figure 11:
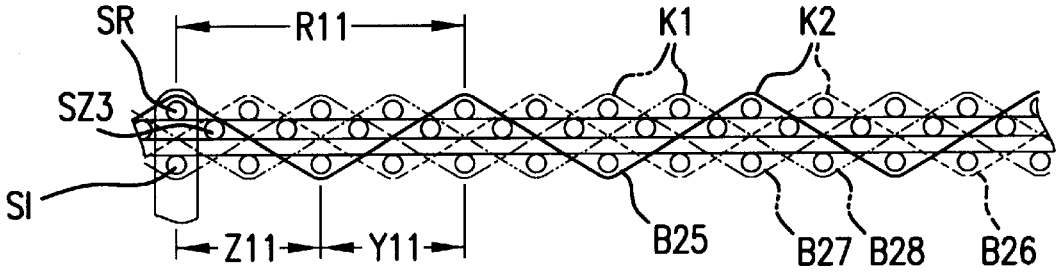
FIG. 11 is a representation as in FIG. 9 with a third variant of the arrangement of the intermediate fillings, whereby the group of chain warp yarns consists of four chain warp yarns assigned to two warp courses.

FIGS. 9 to 11 show the regular tie-in of filling yarns SR, SI, SZ by chain warp yarns B25, B26, B27, whereby the chain warp yarns in reciprocal alternation fix filling yarns SR, SI individually almost symmetrically according to a uniform weave design with the pattern repeat R9, R10, R11.

The differences between the individual FIGS. 9 to 11 consist only in the different position of the intermediate fillings SZ1 (above the inner filling), SZ2 (below the back filling), and SZ3 (between the back filling and inner filling).

Chain warp yarns B25, B26, B27, B28 of each of these back cloths can be arranged with respect to a group in one to four warp courses.

Figure 12:
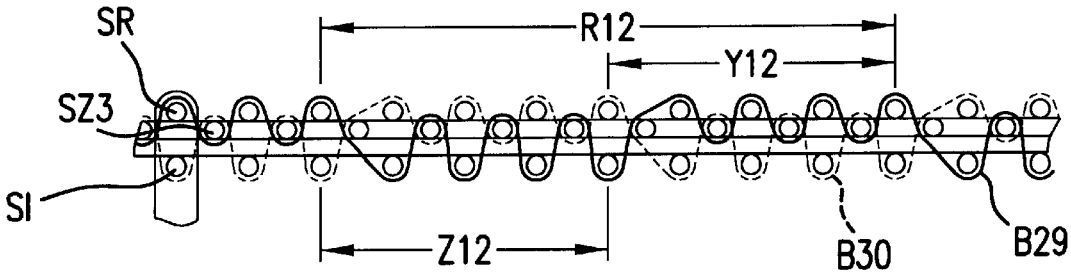
FIG. 12 is a representation of a top cloth with the filling arrangement of FIG. 11, whereby the chain warp yarns loop around the back- and intermediate fillings in lengths in tabby weave and in the following length bind the intermediate and inner fillings.

In FIG. 12, a pattern repeat R12 of a chain warp yarn B29, B30 consists of holding lengths Y12 and compensating lengths Z12 with different weave designs of the tabby weave type between inner filling SI and intermediate filling SZ3 or between back filling SR and intermediate filling SZ3. All back fillings SR and all inner fillings SI are loaded symmetrically by chain warp yarns B29, B30. The tie-in length of chain warp yarns B29, B30 of this group is compensated for by two change lengths W respectively, as in the Example of FIG. 2.

Figure 13:
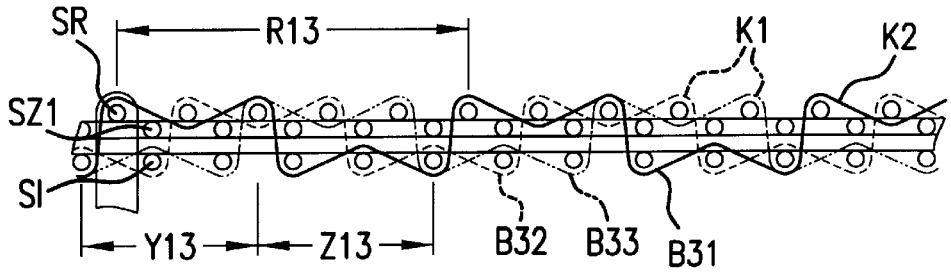
FIG. 13 is a representation as in FIG. 7, whereby an additional intermediate filling is provided.

The weave design of FIG. 13 is essentially comparable to the weave design of FIG. 7. Change lengths W are shortened, however.

Holding lengths Y13 extend over five filling insertion cycles; compensating lengths Z13 likewise.

The additional intermediate fillings SZ1, which press stuffer warp FK against back fillings SR, ensure a slight curvature of stuffer warp FK that additionally prevents back fillings SR from sliding in the warp direction. Although individual back fillings SR are loaded unsymmetrically in the warp direction, they maintain their original position in combination with the adjacent fillings. Thus they enable an exact orientation of the pile legs vertical to the back cloth.

Figure 14:
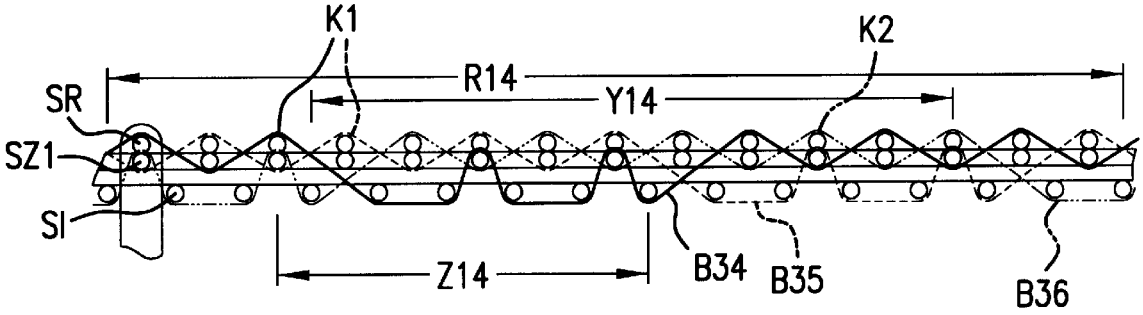
FIGS. 14 and 15 are modifications of the weave of FIG. 13.
Figure 15:
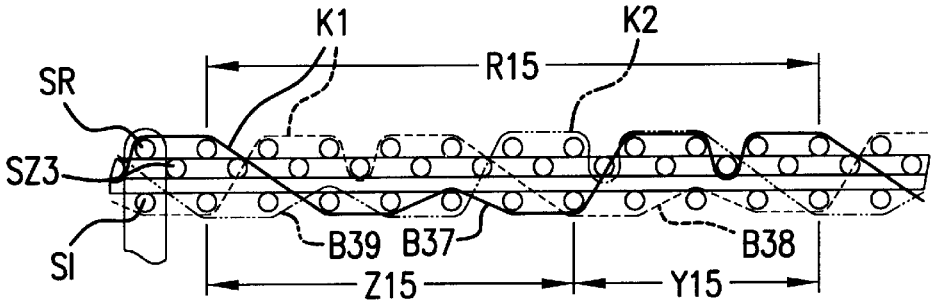

FIGS. 14 and 15 contain further modifications to FIGS. 7 and 8. Intermediate fillings SZ2, SZ3 serve here to fix back fillings SR additionally, without chain warp yarns B34, B35, B36, or B37, B38, B39 extending regularly over the entire cross section of back cloth OW.

With the embodiments described here, it is possible distinctly to reduce the number and incorporation of chain warp yarns B34, B35, B36, or B37, B38, B39. All the weave variants described have the effect of causing the pile legs to project vertically: from the back cloth—reliably and with feasible tolerances.

The reason for this varies in detail. The subject of FIGS. 16 to 18 is to represent the principles active thereby.

Figure 16:
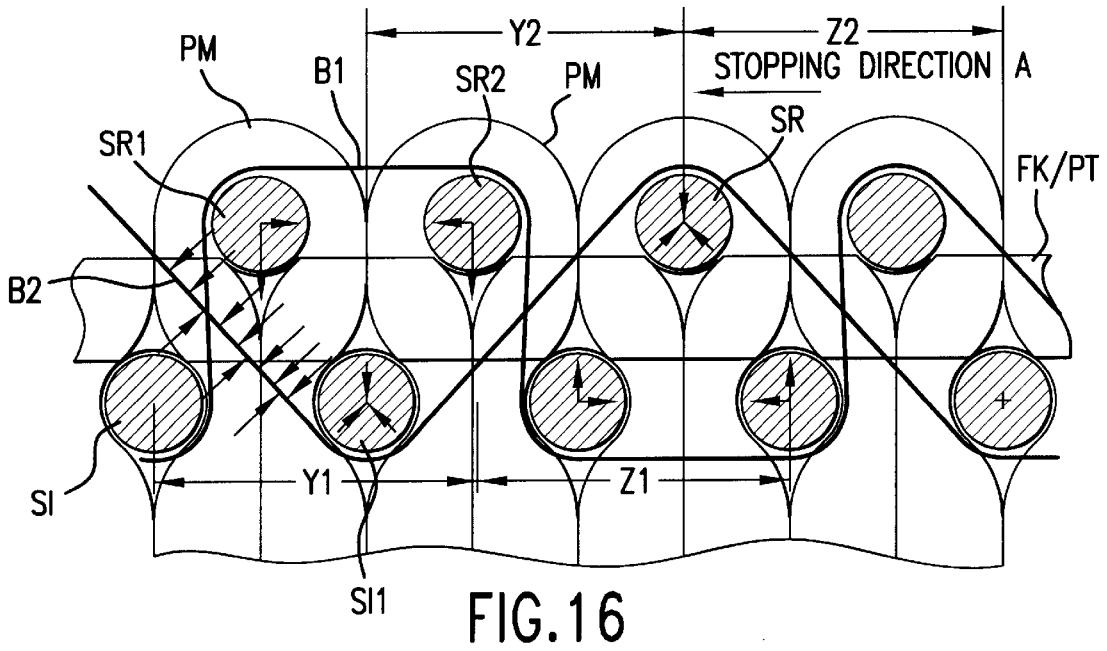
FIG. 16 is a diagram of the paired filling weave for back fillings on a top cloth as in FIGS. 1 and 2.

In the weave design of FIG. 16, the symmetrical loading of a pair of filling yarns by chain warp B1 is utilized. Chain warp B2 with its diagonally oriented holding length Y2 and compensating length Z2 deliver the necessary forces to hold filling yarn pair SR1 and SR2 against one another in the warp direction. The increase of inner tensions in chain warps B1, B2 is avoided by the looping friction in combination with the friction caused by the gripping action within the finished fabric. Not only the density in the filling direction but also the density in the warp direction can be increased with the distribution of chain warp yarns B1 and B2 in adjacent warp courses. Laterally overlapping points of intersection of chain warp yarns B1, B2 are avoided at the densest points in the fabric.

Figure 17:
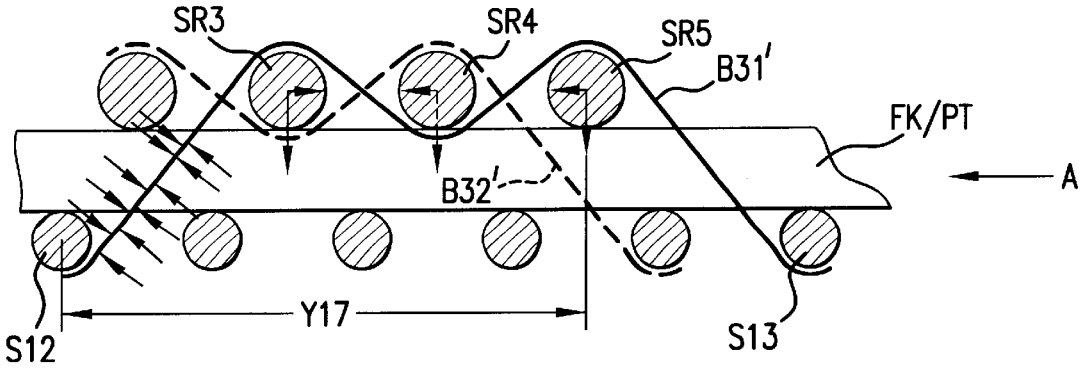
FIG. 17 is a diagram when tabby weave is used on the back fillings on a top cloth.

In the weave design according to FIG. 17, back fillings SR or inner fillings SI within holding lengths Y17 (and also in compensating lengths 7 FIG. 7) are held against one another in their respective plane by means of tabby weave. All back fillings SR and also all inner fillings SI are held firmly against stuffer warp FK or dead piles PT respectively by means of at least one diagonal chain warp yarn length. In this manner the back cloth is very stable. Longitudinal forces (in the warp direction) in this system are additionally applied by the diagonal yarn length inside holding length Y17. Here too, the gripping forces have a favorable effect on this yarn length in the finished fabric. In the finished fabric, back fillings and inner fillings SR, SI remain where they are positioned during the beat-up (beat-up direction A).

Figure 18:
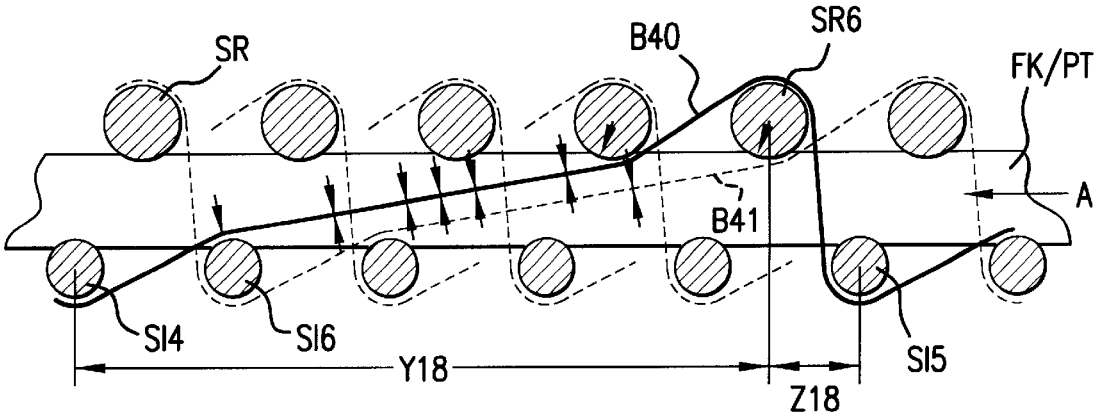
FIG. 18 is a weave diagram with tie-in of the chain warp yarns asymmetrically under tension, using their gripping action in the finished fabric of a top cloth.

FIG. 18 shows a weave design variant according to the invention that enables a vertical tie-in of the pile legs in spite of the asymmetry of the weave pattern. After being bound to inner filling S14 within holding length Y18, chain warp yarn B40 is guided over eight filling insertion cycles in the area of dead piles PT and stuffer warp FK. In this area it is stretched in the finished fabric and simultaneously gripped on all sides. The tensile force applied by it is exerted uniformly in beat-up direction A on all back fillings positioned in its effective area.

Although it appears in this weave that inner fillings SI are loaded in exactly the opposite direction, no deflection in this direction has been found in practice. It is highly probable that the reason for this is that the gripping forces on long holding length Y18 within the finished fabric are so great that no deflection of the inner fillings takes place during a repeated filling beat-up. Even in this asymmetrical weave, the pile loops regularly project vertically from the back cloth.

The number of possible weaves is not yet exhausted with these Examples. It has been found that there must be certain numbers of filling insertion cycles in defining the sum of the lengths of holding lengths Y, chain warp yarns B of a group, and total pattern repeat length R of chain warp yarns B, if the desired effects are to be achieved regularly.

The density of the cross connections between back fillings SR and inner fillings SI ensures the necessary stability of the back cloth and the equally necessary friction of the fillings against the warp yarn strand (PT/FK).

Finally, we should mention that in particular the weave shown in FIG. 18 can also be woven in the opposite direction with similar effects. The asymmetrical tension on the back fillings will not be capable of changing the position of the back fillings during the repeated filling beat-ups, because of the stretched orientation of the compensating length (this would then be Z18) between back fillings and inner fillings SR, SI. The gripping forces on chain warp yarns B building up within the finished fabric support this procedure. An almost vertical orientation of the pile yarn legs can also be achieved with this variant.

The results when a high pile density is achieved are similarly effective when a certain pattern repeat length is ensured. The saving of material for the chain warp overall is also fully effective in this variant.

Figure 19:
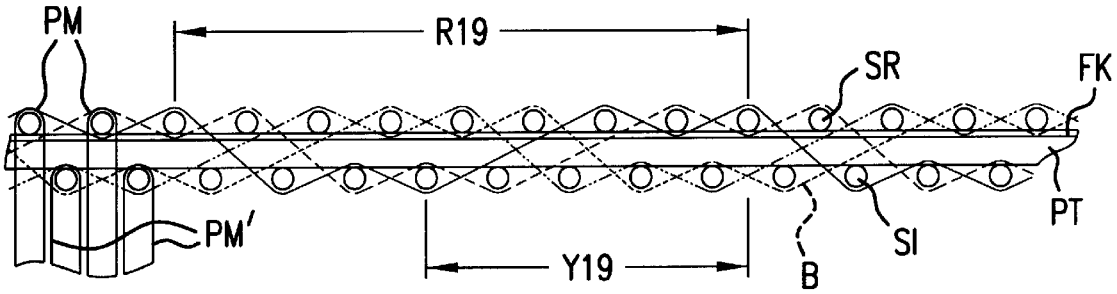
FIGS. 19 to 22 show further weave examples with pile loops interlacing unevenly with back-, intermediate, or inner fillings.
Figure 20:
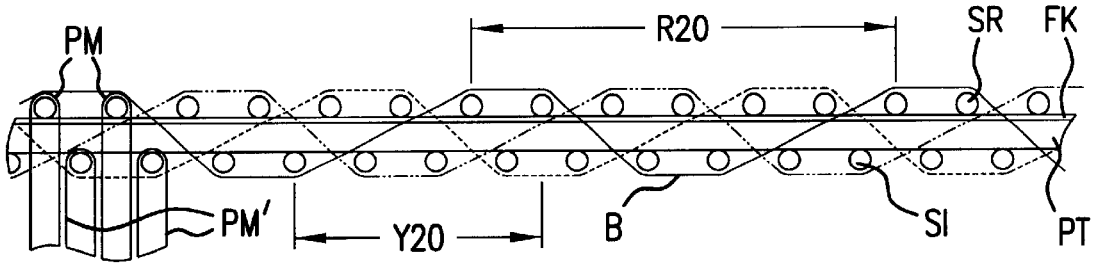

The principles of the present invention can also be used in the weaving of face-to-face carpet fabrics in which not every patterning pile loop is stretched over a back filling. Examples of this are shown in FIGS. 19 and 20 for fabrics that have exclusively back fillings SR and inner fillings SI. Pile loops PM and PM' are here bound alternately by back fillings SR and inner filling SI.

Chain warp B in FIG. 19 follows a pattern repeat R19 that extends over 16 filling insertion cycles. The weave design is similar to that of FIG. 7.

In FIG. 20 pattern repeat R20 extends over 12 filling insertion cycles. It is similar to that of FIG. 6.

Figure 21:
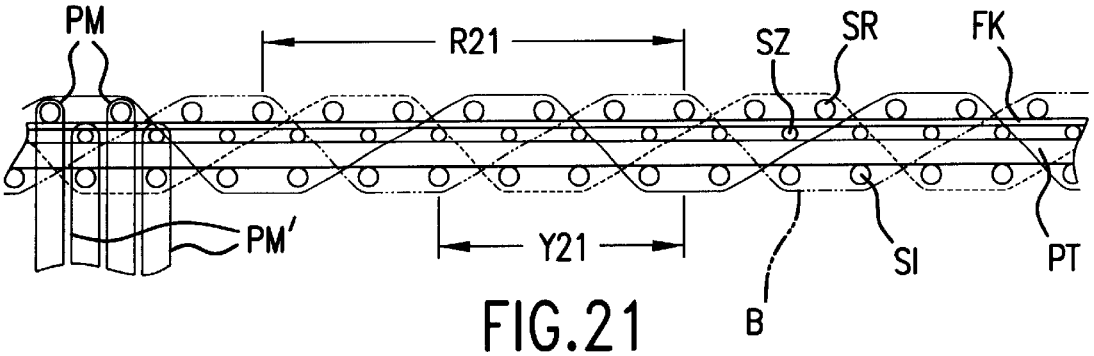
Figure 22:
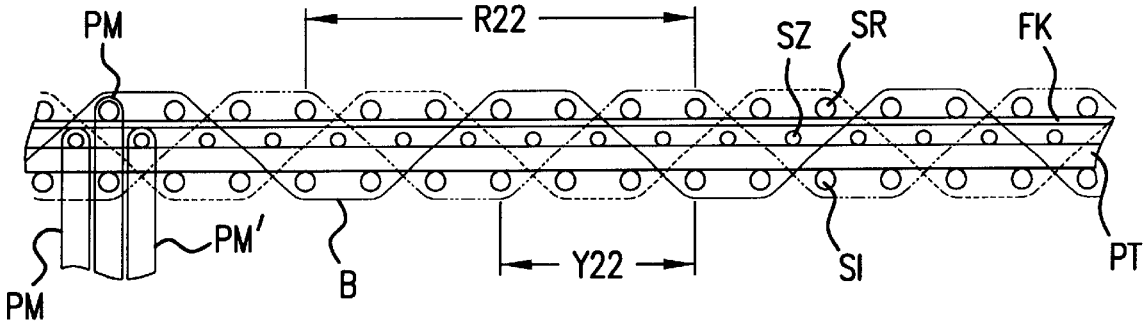

FIGS. 21 and 22 show weave designs in which fillings SR, SI in top cloth OW are arranged in 3 planes respectively. Chain warp yarns B bind respectively over a pair of back fillings SR or inner fillings SI in the respective back cloth OW or UW. Pile loops PM, PM' pass alternately once over a back filling SR and then over an intermediate filling SZ.

With these weave designs, a distinctly higher pile density and a saving of material for chain warp B are also achieved. The pile loops project sufficiently vertically from the back cloth here too.

What is claim is:

1. A process for the production of a face-to-face carpet fabric on a double pile loom having at least two filling insertion planes, the fabric including filling yarns, warp courses with stuffer warp yarns, and chain warp yarns forming back cloths in the form of a bottom cloth and a top cloth, and frames of patterning and non-patterning pile yarns per warp course forming a patterned pile layer between the two back cloths, the non-patterning pile yarns being tied into at least one of the top cloth and the bottom cloth substantially under tension and the patterning pile yarns being stretched alternately between the filling yarns of the top cloth and the bottom cloth, each of the patterning pile yarns in each of the two back cloths being stretched exclusively over one of the back fillings, the process comprising:

(a) inserting the filling yarns within a pattern repeat in both back cloths in at least two different filling insertion planes, at least once as a back filling outside the stuffer warp yarns and at least once as an inner filling inside the stuffer warp yarns, (b) in each back cloth, feeding groups of chain warp yarns according to the pattern repeat, forming weaving sheds, (c) staggering the chain warp yarns of a group within the pattern repeat in the warp direction and looping in harmonizing weaving sequences outside back filling yarns of the filling yarns and inside the inner filling yarns of the filling yarns with respect to respective ones of said back cloths, (d) guiding each chain warp yarn of a group within a weaving sequence between a respective last binding to one of the inner fillings and a subsequent last binding to one of the back fillings over several filling insertion cycles outside the inner fillings, forming a holding length, and then on the pile side one of the inner fillings in a compensating length, forming a weaving shed, and (e) selecting the pattern repeats of the chain warp yarns so that a tie-in length of the chain warp yarns of a group within each said pattern repeat is compensated for between them, each of the chain warp yarns of a group within a particular said pattern repeat greater than six filling insertion cycles forming the holding length that extends over at least three successive tilling insertion cycles, the number of the chain warp yarns to be used per group being at least equal to the number of the back fillings of the respective cloth per pattern repeat, divided by the number of back filling bindings per pattern repeat of the chain warp yarn of the group and each group of the chain warp yarns being distributed in at least two successive adjacent warp courses.

2. The process of claim 1, wherein said step of guiding includes guiding each said chain warp yarn in a same manner as the non-patterning pile yarns in at least two successive courses during the formation of the holding length within its pattern repeat so as to form one of said weaving sheds, each said chain warp yarn then remains in the respectively outermost shed plane over three successive courses in order to complete the holding length, each said chain warp yarn binds with the inner fillings in the compensating length, making up the weaving sequence, and each group consists of at least four of said chain warp yarns.

3. The process of claim 1, wherein said step of guiding includes guiding each said chain warp yarn in a same manner as the non-patterning pile yarns in at least two successive courses during the formation of the holding length within its pattern repeat so as to form one of said weaving sheds, each said chain warp yarn then binds exclusively with the back fillings in five successive courses in tabby weave in order to complete the holding length, and then this chain warp yarn binds with the inner fillings in the compensating length, making up the weaving sequence.

4. The process of claim 1, wherein said step of guiding includes arranging the holding lengths and the compensating lengths in mirror image to one another within a pattern repeat both in the warp direction and also in relation to the respective stuffer warp.

5. The process of claim 1, wherein said step of guiding includes guiding each said chain warp yarn in a same manner as the non-patterning pile yarns in at least six successive courses during the formation of the holding length within its pattern repeat so as to form one of said weaving sheds, each said chain warp yarn then binds outside one of said back fillings in at least one course in order to complete the holding length, and then said chain warp yarn binds inside one of said inner fillings in a single course in the compensating length, making up the weaving sequence.

6. The process of claim 1, wherein said step of guiding including forming two separate ones of said holding length and two separate ones of said compensating length from each said chain warp yarn within the pattern repeat corresponding thereto.

7. The process of claim 1, further comprising inserting intermediate fillings in an additional plane between the plane of the back fillings and the plane of the inner fillings.

8. A process for the production of a face-to-face carpet fabric on a double pile loom having at least two filling insertion planes, the fabric including filling yarns, warp courses with stuffer warp yarns, and chain warp yarns forming back cloths in the form of a bottom cloth and a top cloth, and frames of patterning and non-patterning pile yarns per warp course forming a patterned pile layer between the two back cloths, the non-patterning pile yarns being tied into at least one of the top and the bottom cloth under tension and the patterning pile yarns being stretched alternately between the filling yarns of the top cloth and the bottom cloth, each of the patterning pile yarns in each of the two back cloths being stretched over one of the back fillings, the process comprising:

(a) inserting the filling yarns within a pattern repeat in both back cloths in at least two different filling insertion planes, at least once as a back filling outside the stuffer warp yarns and at least once as an inner filling inside the stuffer warp yarns, (b) in each back cloth, feeding groups of chain warp yarns are fed according to the pattern repeat, forming weaving sheds, (c) staggering the chain warp yarns of a group within the pattern repeat in the warp direction and looping in harmonizing weaving sequences outside back filling yarns of the filling yarns and inside the inner filling yarns of the filling yarns with respect to respective ones of said back cloths, (d) guiding each chain warp-yarn within a weaving sequence between a respective last binding to one of the inner fillings and a subsequent last binding to one of the back fillings over several filling insertion cycles outside the inner fillings, forming a holding length, and then on the pile side one of the inner fillings in a compensating length, forming a weaving shed, and (e) selecting the pattern repeats of the chain warp yarns so that a tie-in length of the chain warp yarns of a group within each said pattern repeat is compensated for between them, each of the chain warp yarns of a group within a particular said pattern repeat including at least six filling insertion cycles forming the holding length and the compensating length that each extend over at least three successive filling insertion cycles subsequent to one another, and each group of the chain warp yarns consisting of three chain warp yarns distributed in at least two closely adjacent warp courses.

9. The process of claims 1 or 8, further comprising feeding individual said chain warp yarns of said two adjacent groups of said chain warp yarns in one said warp course.

10. The process of claims 1 or 8, further comprising binding at least two said chain warp yarns of a group simultaneously, and in a same manner with one and the same filling yarn in adjacent said warp courses in one or more pattern repeat steps.

11. A process for the production of a face-to-face carpet fabric on a double pile loom having at least two filling insertion planes, the fabric including filling yarns, warp courses with stuffer warp yarns, and chain warp yarns forming back cloths in the form of a bottom cloth and a top cloth, and frames of patterning and non-patterning pile yarns per warp course forming the patterned pile layer between the two back cloths, the non-patterning pile yarns being tied into at least one of the top and the bottom cloth substantially under tension and the patterning pile yarns being stretched alternately between the filling yarns of the top cloth and the bottom cloth, a second patterning pile loop in each of the two back cloths being stretched over the back filling and intermediate pile loops being stretched over one said inner filling or an intermediate filling, the process comprising:

(a) inserting the filling yarns within a pattern repeat in both back cloths in at least two different filling insertion planes, at least once as a back filling outside the stuffer warp yarns and at least once as an inner filling inside the stuffer warp yarns (b) in each back cloth, feeding groups of chain warp yarns according to the pattern repeat, forming weaving sheds, (c) staggering e chain warp yarns of a group within the pattern repeat in the warp direction and looping in harmonizing weaving sequences outside back filling yarns of the filling yarns and inside the inner filling yarns of the filling yarns with respect to respective ones of said back cloths, (d) guiding each chain warp yarn of a group within a weaving sequence between a respective last binding to one of the inner fillings and a subsequent last binding to one of the back fillings over several filling insertion cycles outside the inner fillings, forming a holding length, and then on the pile side one of the inner fillings in a compensating length, forming a weaving shed, and (e) selecting the pattern repeats of the chain warp yarns so that a tie-in length of the chain warp yarns of a group within each said pattern repeat is compensated for between-them, each chain warp yarn of a group within a particular said pattern repeat greater than eight filling insertion cycles forming the holding length that extends over at least five successive filling insertion cycles, the number of said chain warp yarns to be used per group being at least equal to the number of the back fillings of the respective cloth per pattern repeat, divided by the number of back filling bindings per pattern repeat of a chain warp yarn of the group and each group of said chain warp yarns being distributed in at least two successive adjacent warp courses.

12. The process of claim 7, wherein each said chain warp yarn also binds during a tabby weave to one or more intermediate fillings in the holding lengths and the compensating lengths.

* * * * *